US011535473B2

(12) United States Patent
Capitani

(10) Patent No.: US 11,535,473 B2
(45) Date of Patent: Dec. 27, 2022

(54) METHOD AND A SYSTEM FOR MOVING AND LABELLING REELS OF A WEB MATERIAL

(71) Applicant: Valmet Aktiebolag, Sundsvall (SE)

(72) Inventor: Marco Capitani, Lucca (IT)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 17/639,101

(22) PCT Filed: Oct. 14, 2020

(86) PCT No.: PCT/EP2020/078868
§ 371 (c)(1),
(2) Date: Feb. 28, 2022

(87) PCT Pub. No.: WO2021/074207
PCT Pub. Date: Apr. 22, 2021

(65) Prior Publication Data

US 2022/0315370 A1 Oct. 6, 2022

(30) Foreign Application Priority Data

Oct. 16, 2019 (EP) ..... 19203659

(51) Int. Cl.
*B65H 19/30* (2006.01)
*B65C 3/00* (2006.01)
(Continued)

(52) U.S. Cl.
CPC ..... *B65H 19/30* (2013.01); *B65C 3/00* (2013.01); *B65C 9/06* (2013.01); *B65C 9/28* (2013.01);
(Continued)

(58) Field of Classification Search
CPC ..... B65H 19/30; B65H 2301/4173; B65H 2301/54; B65H 2406/34; B65H 2555/30;
(Continued)

(56) References Cited

U.S. PATENT DOCUMENTS

| | | | | |
|---|---|---|---|---|
| 8,413,407 | B2 | 4/2013 | Barsacchi | |
| 2017/0327336 | A1* | 11/2017 | Vergentini | B65H 19/18 |
| 2018/0141772 | A1* | 5/2018 | Prankl | B65H 19/12 |

FOREIGN PATENT DOCUMENTS

| | | | |
|---|---|---|---|
| CN | 107826373 | A | 3/2018 |
| JP | H02-233340 | A | 9/1990 |

(Continued)

OTHER PUBLICATIONS

European Patent Office, Extended European Search Report received for Application No. 19203659.8, dated May 12, 2020, 5 pages, Germany.

(Continued)

*Primary Examiner* — Glenn F Myers
(74) *Attorney, Agent, or Firm* — Alston & Bird LLP

(57) ABSTRACT

The invention relates to a method and a system for moving and labelling reels ($R_1$, $R_2$, $R_3$, $R_4$, . . . $R_n$) of a web material such as paper or nonwoven in which each reel has a central core piece (3) which is hollow and around which the web material is wound. A robot arm (6) is inserted into the central core piece (3) of at least one reel ($R_1$) and is then used to move the ($R_1$) from a first position (P1) to a second position (P2) and to fix an inner label (15) onto the central core piece (3). According to the invention, the inner label (15) is placed on the robot arm (6) before the robot arm (6) is inserted into the central core piece (3) and the robot arm (6) is used both to fix the inner label (15) to the central core piece (3) and to move the at least one reel ($R_1$).

17 Claims, 14 Drawing Sheets

(51) Int. Cl.
*B65C 9/28* (2006.01)
*B65C 9/06* (2006.01)

(52) U.S. Cl.
CPC .. *B65H 2301/4173* (2013.01); *B65H 2301/54* (2013.01); *B65H 2406/34* (2013.01); *B65H 2555/30* (2013.01)

(58) Field of Classification Search
CPC .... B65C 3/00; B65C 3/02; B65C 9/06; B65C 9/28; B65C 9/14; B65C 9/1819; B65C 9/1826
See application file for complete search history.

(56) References Cited

FOREIGN PATENT DOCUMENTS

| | | | |
|---|---|---|---|
| JP | 2007-320564 | A | 12/2007 |
| JP | 2010-222042 | A | 10/2010 |
| WO | WO 2006/042899 | A1 | 4/2006 |

OTHER PUBLICATIONS

International Searching Authority, International Search Report and Written Opinion received for International Application No. PCT/EP2020/078868, dated Nov. 25, 2020, 9 pages, European Patent Office, Netherlands.
China National Intellectual Property Administration, Search Report received for Application No. 202080071812.9, dated Aug. 19, 2022, 2 pages, PRC.

* cited by examiner

METHOD AND A SYSTEM FOR MOVING AND LABELLING REELS OF A WEB MATERIAL

CROSS REFERENCE TO RELATED APPLICATIONS

This application is a national phase application based upon International Application No. PCT/EP2020/078868, filed Oct. 14, 2020, which international application claims priority to and the benefit of European Application No. 19203659.8, filed Oct. 16, 2019; the contents of both of which as are hereby incorporated by reference in their entireties.

BACKGROUND

Technical Field

The present invention relates to a method and a system for moving and labelling reels of a web material such as paper or nonwovens.

Description of Related Art

When reels of tissue paper, a nonwoven material or other similar wound material come from a converting or production line, they are picked up, labelled, stacked and sent to a packaging station where they are typically packaged in a plastic film. In a known method for moving and labelling such reels, a first reel is picked up from a robot table where several reels are standing next to each other, the central axes of the reels being oriented horizontally. An industrial robot picks up the first reel, moves it from the robot table and turns it such that the central axis of the roll becomes vertical. The first reel is then dropped on a roller conveyor after which the reel is provided with an internal label and an external label. Following this, the industrial robot picks up the next reel and places it on the first reel where it is labelled. In such a way, a stack of reels is formed that can then be transported away on the roller conveyor for packaging in a plastic film. It is considered necessary to put a label on both an external surface of each reel and on the inside of the reel as the reels are often sent further on to converting machines (for example for making diapers) and the operator of a converting machine will normally remove the external label. If there is a problem in the converting machine, for example due to a faulty reel, the internal label makes it easier to identify the reel. U.S. Pat. No. 8,413,407 discloses an automated system for producing and managing rolls of web material in which a labeling machine to label each roll coming from a rewinder is included. The objective of the present invention is to provide an improved method of moving and labelling reels.

BRIEF SUMMARY

The invention relates to a method of moving and labelling reels of a web material such as paper or nonwovens. Each reel has a central core piece which is hollow and the web material is wound around the central core piece. The method comprises the steps of inserting a robot arm into the central core piece of at least one reel and using the robot arm to move the at least one reel from a first position to a second position. The method further comprises the step of fixing an inner label onto the central core piece. According to the invention, the inner label is placed on the robot arm before the robot arm is inserted into the central core piece and the robot arm is used both to fix the inner label to the central core piece and to move the at least one reel.

In embodiments of the inventive method, the inner label is fixed onto the central core piece before the robot arm is used to move the at least one reel.

The method may further optionally also comprise fixing an outer label onto an exterior surface of the at least one reel.

In other embodiments of the inventive method, the inner label may be fixed onto the central core piece while the at least one reel is moved from the first position to the second position In advantageous embodiments of the invention, the robot arm can be used to move at least two reels simultaneously and fix an inner label onto the central core piece of each of the at least two reels.

The labels may advantageously be fixed by means of adhesive. In advantageous embodiments, an adhesive is applied to a first side of the inner label while suction is applied from the robot arm against the second side of the inner label. In this way, the robot arm can hold the inner label by suction when the robot arm is inserted into the central core piece. The suction is then interrupted when the inner label is to be fixed to the central core piece and pressurized air or gas is used to blow the inner label away from the robot arm toward the central core piece such that the side of the inner label that is provided with an adhesive will come into contact with the central core piece. Conceivably, the inner label could be attached to the central core piece by other means than by blowing. For example, a piston or spring-loaded pad which projects from the robot arm could be used to attach the inner label to the central core piece. The robot arm is thus designed to be capable of attaching the inner label to the central core piece either by blowing or by other means.

In embodiments of the invention, the robot arm can grip a reel in the following way. A part of the robot arm that is inserted into the central core piece is caused to expand and press against the central core piece of the at least one reel such that the reel is held by the robot arm while the at least one reel is still in the first position. The robot arm can then move the at least one reel which is now held by the robot arm release the at least one reel at the second position. Preferably, the robot arm rotates the at least one reel before it releases the at least one reel at the second position. The expansion can take place after the inner label has been attached to the central core piece but the expansion could conceivably take place at the same time as the inner label is attached to the central core piece or even before the inner label has been attached to the central core piece.

Embodiments are conceivable in which the reel that has been moved to the second position is immediately sent away for further treatment. However, in preferred embodiments, the robot arm stacks several reels on top of each other at the second position.

The invention also relates to a system for moving and labelling reels of a web material such as paper or nonwoven. Each reel has a central core piece which is hollow and the web material is wound around the central core piece. The system comprises at least one machine for printed labels and at least one industrial robot with a moveable robot arm that can be inserted into the central core piece of at least one reel and move the at least one reel from a first position to a second position. According to the invention, the robot arm has an inner conduit which at one end communicates with at least one opening in the robot arm and which at another end is connected to/communicates with a pressure control arrangement capable of creating an underpressure at the at least one opening in the robot arm such that a label placed over the at least one opening can be held by the robot arm by suction.

Preferably, the pressure control arrangement is capable of blowing pressurized air or gas through the conduit in the robot arm such that a label which has been held on the robot arm by suction can be blown away from the robot arm.

In embodiments of the invention, a part of the robot arm is a gripping part that is designed to be capable of radial expansion such that the gripping part of the robot arm can be inserted into the central core piece of at least one reel and grip the reel when the gripping part is radially expanded. Such a gripping part is preferably located adjacent the at least one opening in the robot arm.

In embodiments of the inventive system, the industrial robot comprises software with an instruction to cause the robot arm to move to the at least one machine for printed labels; to pick up at least one label and hold it by means of suction; to move to the at least one reel and into the central core piece such that the label picked up from the at least one machine for printed labels will be inside the central core piece; and to blow pressurized air or gas through the conduit such that the label picked up from the at least one machine for printed labels is blown against the central core piece. The software of the industrial robot may further optionally further comprise an instruction to cause radial expansion of the gripping part after the label picked up from the at least one machine for printed labels has been blown against the central core piece such that the reel is gripped by the robot arm and it may optionally comprise an instruction to move from a first position and release the at least one reel on a second position.

In alternative embodiments, the software of the industrial robot may comprise an instruction to cause radial expansion of the gripping part before the label picked up from the at least one machine for printed labels has been blown against the central core piece. In this case, the reel is gripped by the robot arm and moves from a first position in order to be released by the robot arm on a second position while, during the movement, pressurized air or gas is blown through the conduit such that the label picked up from the at least one machine for printed labels is blown against the central core piece.

DETAILED DESCRIPTION OF VARIOUS EMBODIMENTS

Figure 1:
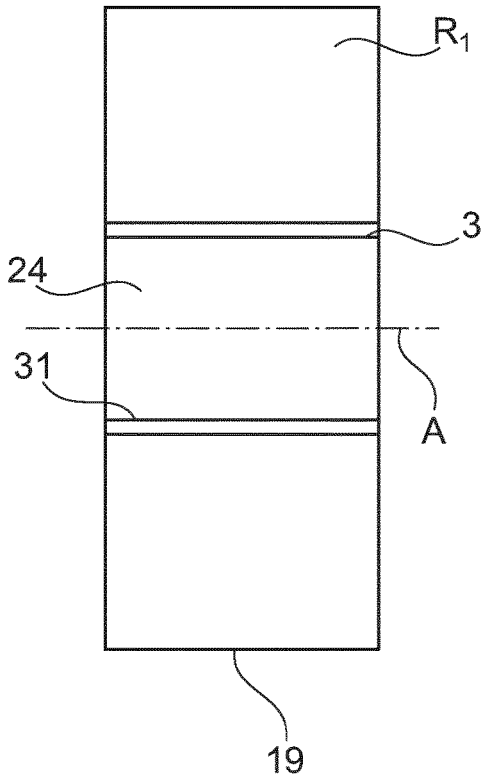
FIG. 1 is a side view of a reel of a web material such as tissue paper or nonwoven.
Figure 2:
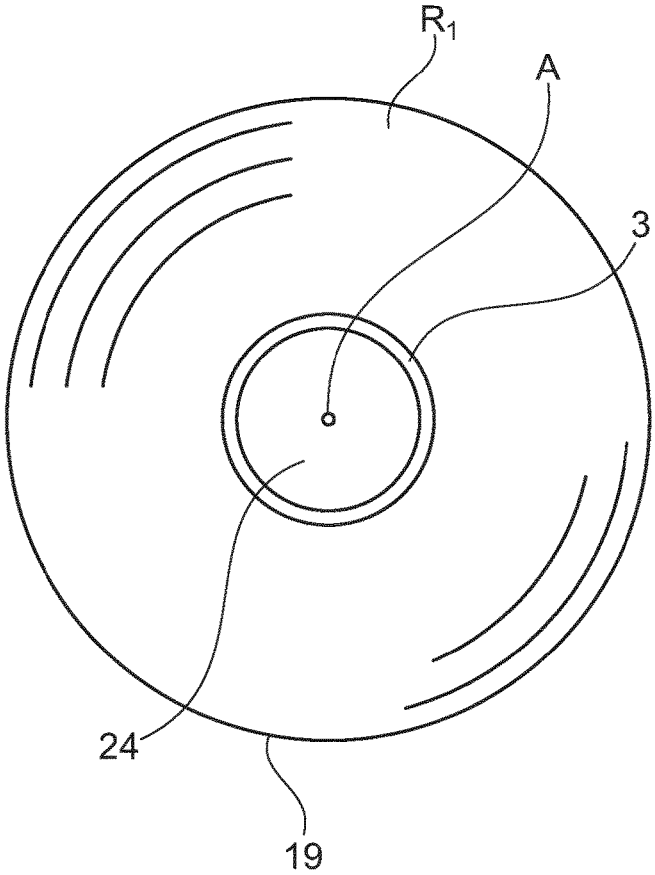
FIG. 2 is a front view of the same reel as in FIG. 1.

With reference to FIG. 1 and to FIG. 2, each reel $R_1$, $R_2$, $R_3 \ldots R_n$ that is to be moved and labelled has a central core piece 3 which is hollow and has an interior wall 31. In FIG. 1 and FIG. 2, the reference numeral 24 represents the hollow at the center of the reel $R_1$ while the central axis of the reel $R_1$ is indicated as A. The reel $R_1$ is formed by a web material such as, for example, a nonwoven material or a paper material such as tissue paper and the web material has been wound around the central core piece 3 which may be of cardboard or another suitable material. The reel $R_1$ has an exterior surface 19. The size of the reels $R_1$, $R_2$, $R_3 \ldots R_n$ may vary but, in many cases, a realistic value for the outer diameter of a reel may be in the range of 800 mm-2200 mm. For example, the outer diameter of a reel $R_1$, $R_2$, $R_3 \ldots R_n$ may be 800 mm, 1200 mm, 1500 mm or 2000 mm. In the same way, the width of the reels $R_1$, $R_2$, $R_3 \ldots R_n$ can also vary from case to case depending on the specific product. In many cases, a realistic value for the width of a reel may be in the range of 50 mm-500 mm but the width could also be greater than 500 mm, in some cases up to 7 m or conceivably even more and the dimension may depend on many different factors. For the central core piece 3, a realistic value for the diameter could often be in the range of 50 mm-305 mm but other sizes are also possible. It should be understood that the numerical values given above are only to be seen as examples of realistic values and that the present invention is applicable to any practical size of reel.

The sequence of moving and labelling reels will now be explained initially with reference to FIGS. 3-9.

Figure 3:
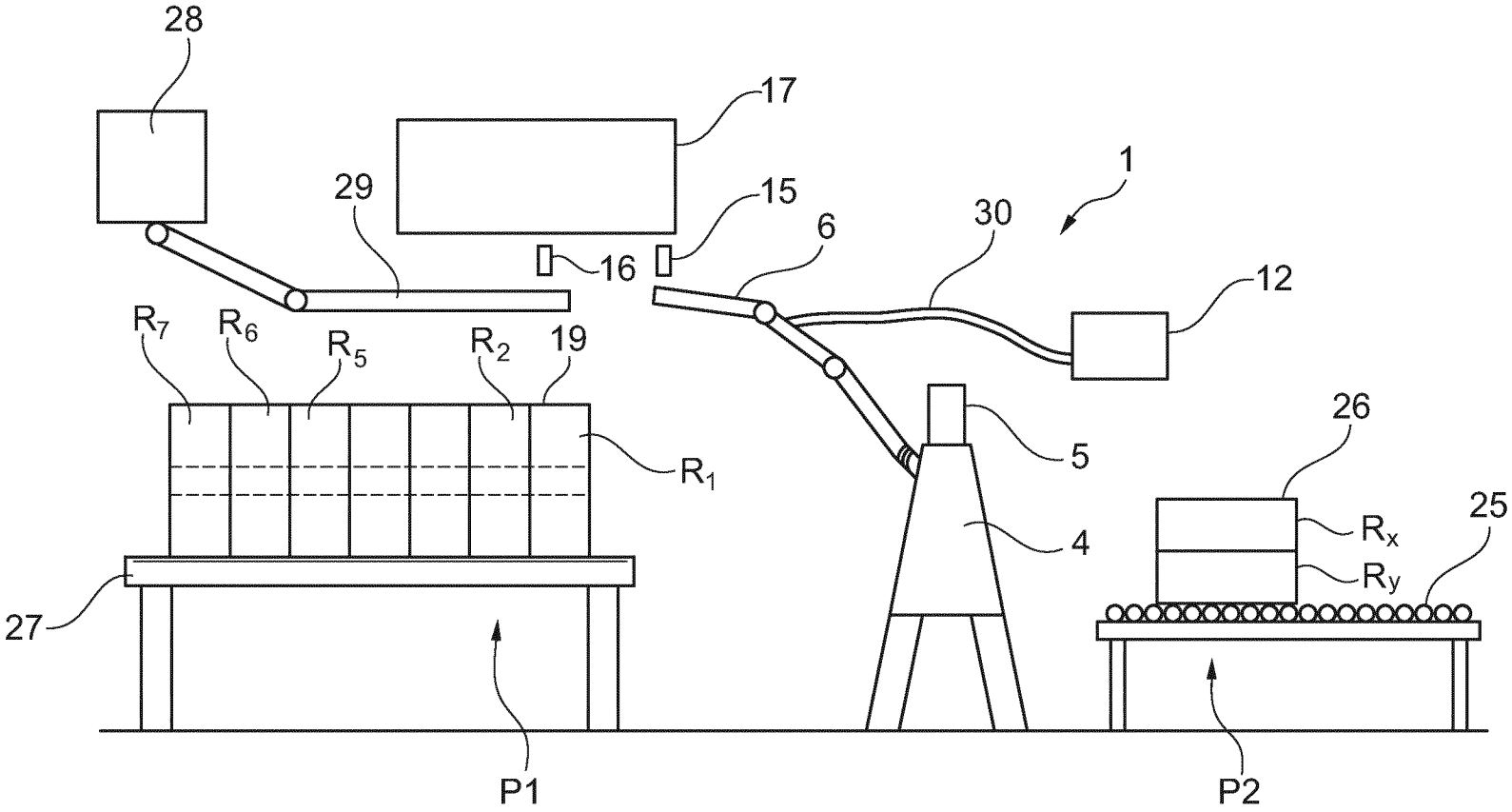
FIG. 3 is a schematic representation of a system for moving and labelling reels which also shows an initial step of the inventive method.

With reference to FIG. 3, the reels $R_1$, $R_2$, $R_3$, $R_4$, $\ldots R_n$ may come from a slitter-rewinder, i.e. a machine that unwinds and cuts a mother roll/jumbo roll into smaller reels $R_1$, $R_2$, $R_3$, $R_4$, $\ldots R_n$ that can be sent to converting. The inventive system 1 for moving and labelling $R_1$, $R_2$, $R_3$, $R_4$, $\ldots R_n$ of a web material comprises at least one machine for printed labels 17 and an industrial robot 4 with a moveable robot arm/carrier beam 6. The machine 17 for printed labels may be a label printing machine or its equivalent, for example a machine/an arrangement with a spool of preprinted labels. The robot arm/carrier beam 6 can be inserted into the central core piece 3 of at least one reel $R_1$ and move the at least one reel $R_1$ from a first position P1 to a second position P2. As can be seen in FIG. 3, a plurality of reels $R_1$, $R_2$, $R_3$, $R_4$, $\ldots R_n$ are placed with their central axes horizontal on a table 27 which may form a part of the inventive system 1. The inventive system 1 may also comprise a roller conveyor 25. A stack 26 of already moved and labelled reels $R_n$, $R_y$ is shown standing on the roller conveyor 25. In FIG. 3, the stack 26 is shown as including only two reels $R_x$, $R_y$ but it should be understood that the stack 26 may comprise more than two such reels. The reference numeral 12 represents a pressure control arrangement which is capable of delivering pressurized air via a tube/conduit 30 or other channel. The pressure control arrangement 12 can also generate underpressure/suction through the tube or conduit 30. The inner conduit 8 of the robot arm 6 is connected to the tube or conduit 30 such that the pressure control arrangement 12 can generate suction through conduit 8 or send pressurized air (or gas) through the inner conduit 8 as will be explained with reference to FIGS. 10-13.

In FIG. 3, an optional additional industrial robot 28 with robot arm 29 is illustrated. The additional industrial robot may be used for putting labels on the exterior surfaces of the reels $R_1$, $R_2$, $R_3$, $R_4$, . . . $R_n$.

Figure 4:
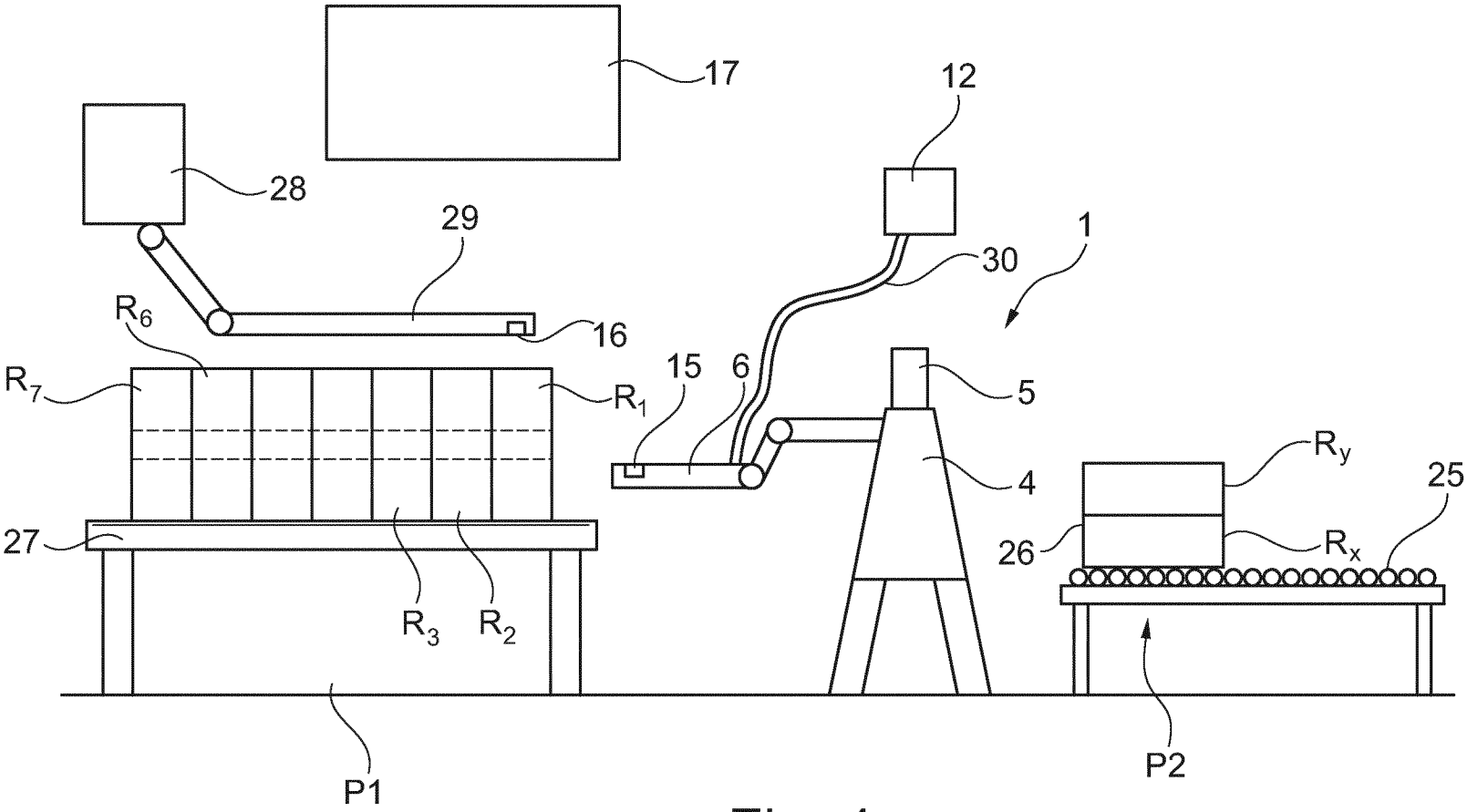
FIG. 4 is a schematic representation of the same system as in FIG. 3 but showing a subsequent step.

FIG. 3 illustrates an initial situation in which the robot arm (or carrier beam) 6 has moved to the at least one machine for printed labels 17 to pick up a label 15 from the machine for printed labels. If the machine 17 for printed labels is a label printing machine, the label 15 will be a label that has been printed from the label printing machine 17. In FIG. 4, the label 15 is held on the robot arm 6 and the robot arm has been moved to a position in which it is aligned with the currently horizontal hollow central core piece 3 of a reel $R_1$. The reel $R_1$ is now in its first position P1.

Figure 5:
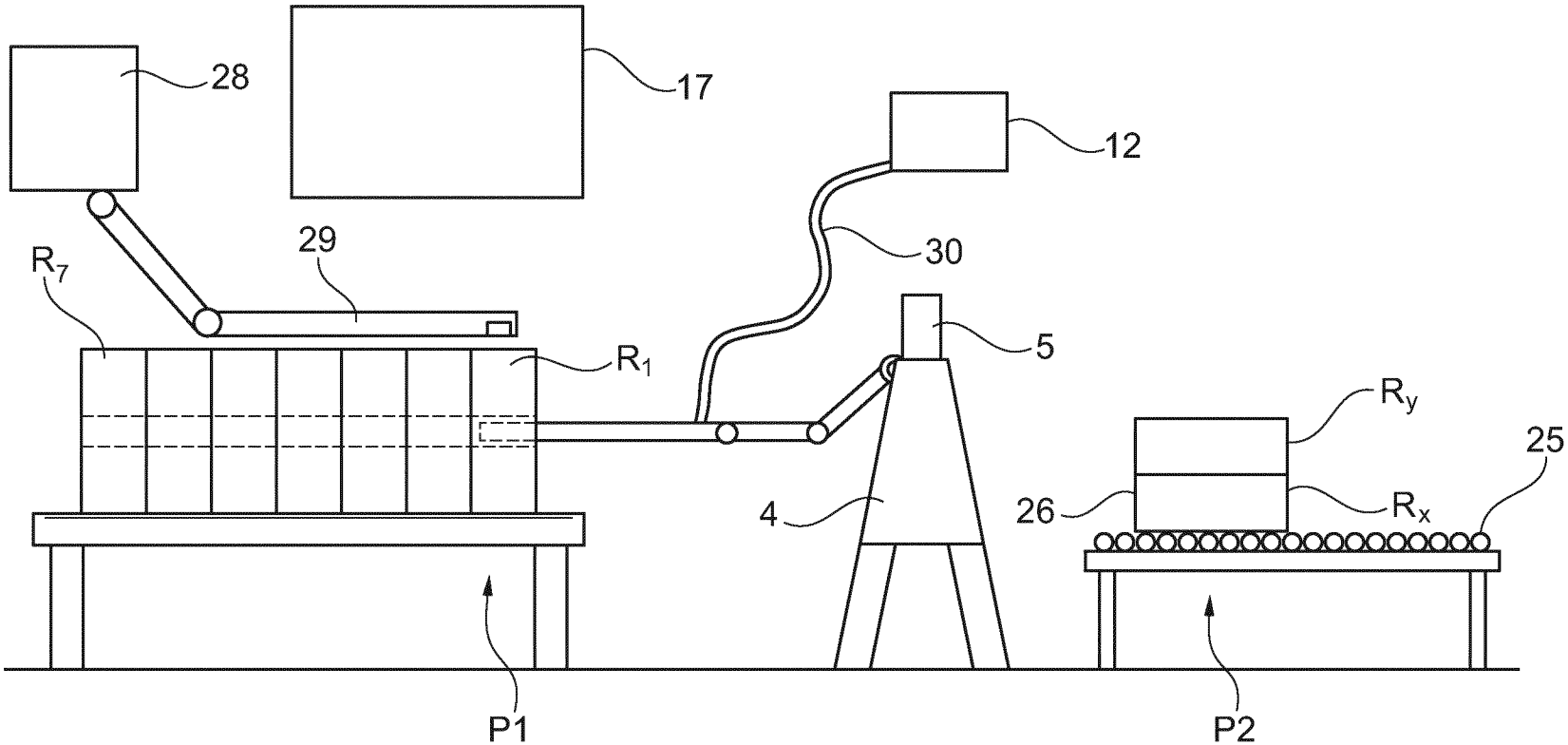
FIG. 5 is a schematic representation of the same system as in FIG. 3 and FIG. 4 but showing a step following the one in FIG. 4

In FIG. 5, the robot arm 6 (or a part thereof) has been inserted into the central core piece 3 of a reel $R_1$. While the robot arm 6 is inside the central core piece 3, the robot arm 6 will fix the label 15 onto the central core piece 3 and grip the reel $R_1$ as will be explained later with reference to FIGS. 10-13.

Figure 6:
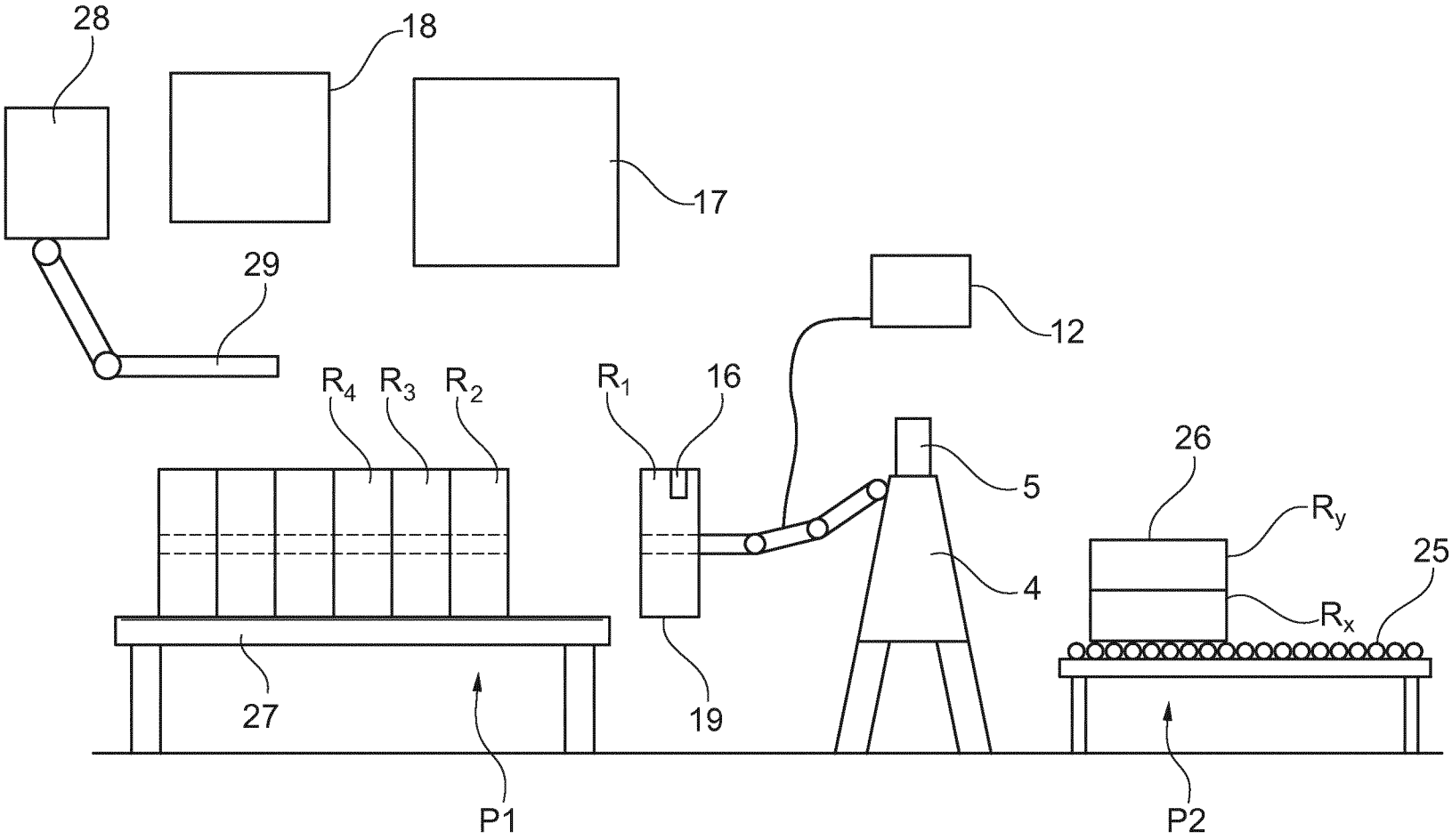
FIG. 6 is a schematic representation of the same system as in FIGS. 3-5 in which the process has taken yet another step.
Figure 7:
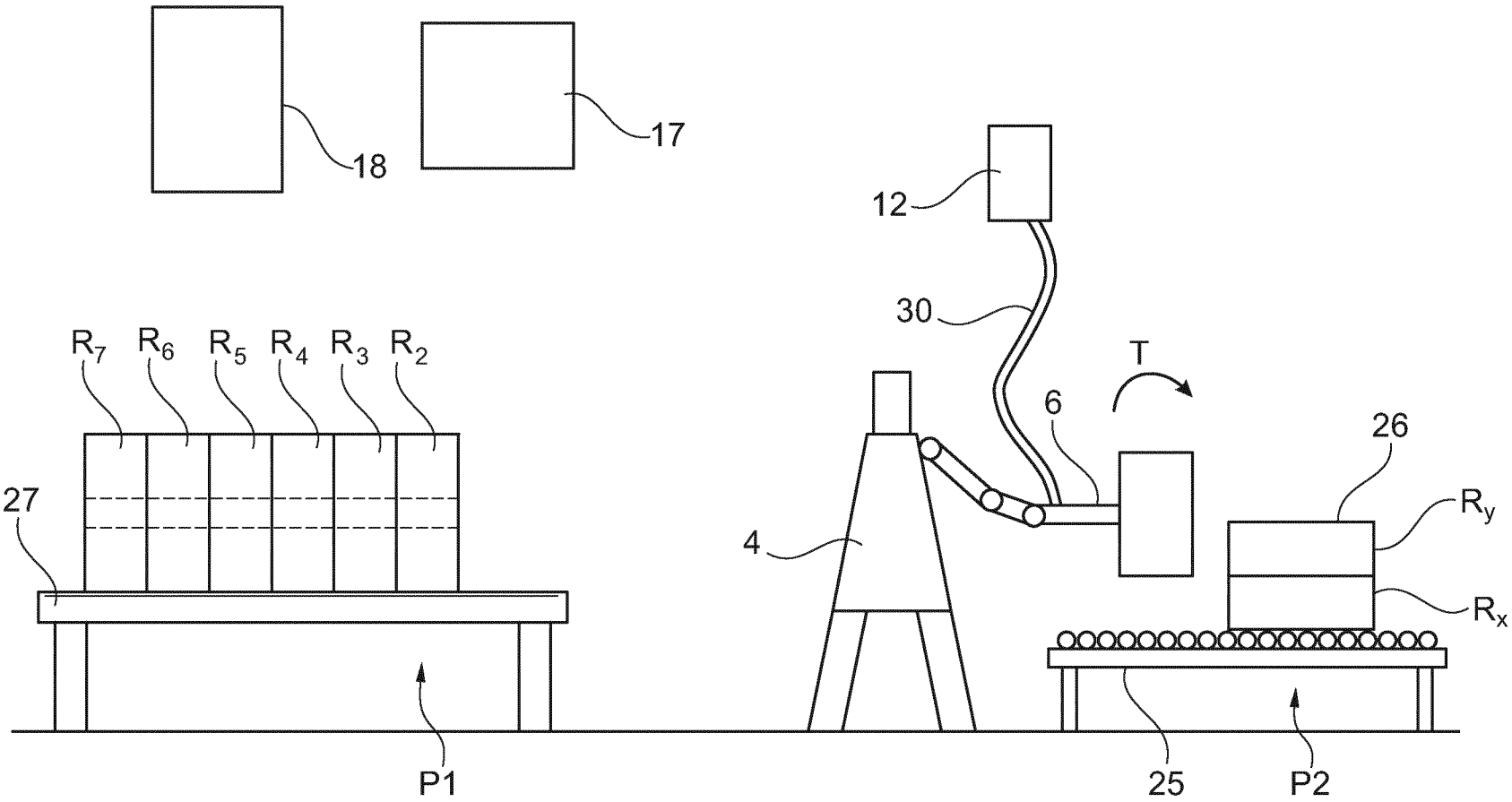
FIG. 7 is a schematic representation similar to FIGS. 3-6 and shows what happens after the situation in FIG. 6.

FIG. 6 shows how the robot arm 6 has moved the reel $R_1$ away from the table 27 and FIG. 7 shows how the industrial robot 4 has moved the robot arm 6 and the reel $R_1$ which is held by the robot arm 6 to a position which is close to the final position P2. In preferred embodiments, the robot arm/carrier beam 6 will now rotate the reel $R_1$, for example as indicated by arrow T such that the central axis A of the reel $R_1$ will become vertical. The expansion can take place after the inner label has been attached to the central core piece but the expansion could conceivably take place at the same time as the inner label is attached to the central core piece or even before the inner label has been attached to the central core piece.

Figure 8:
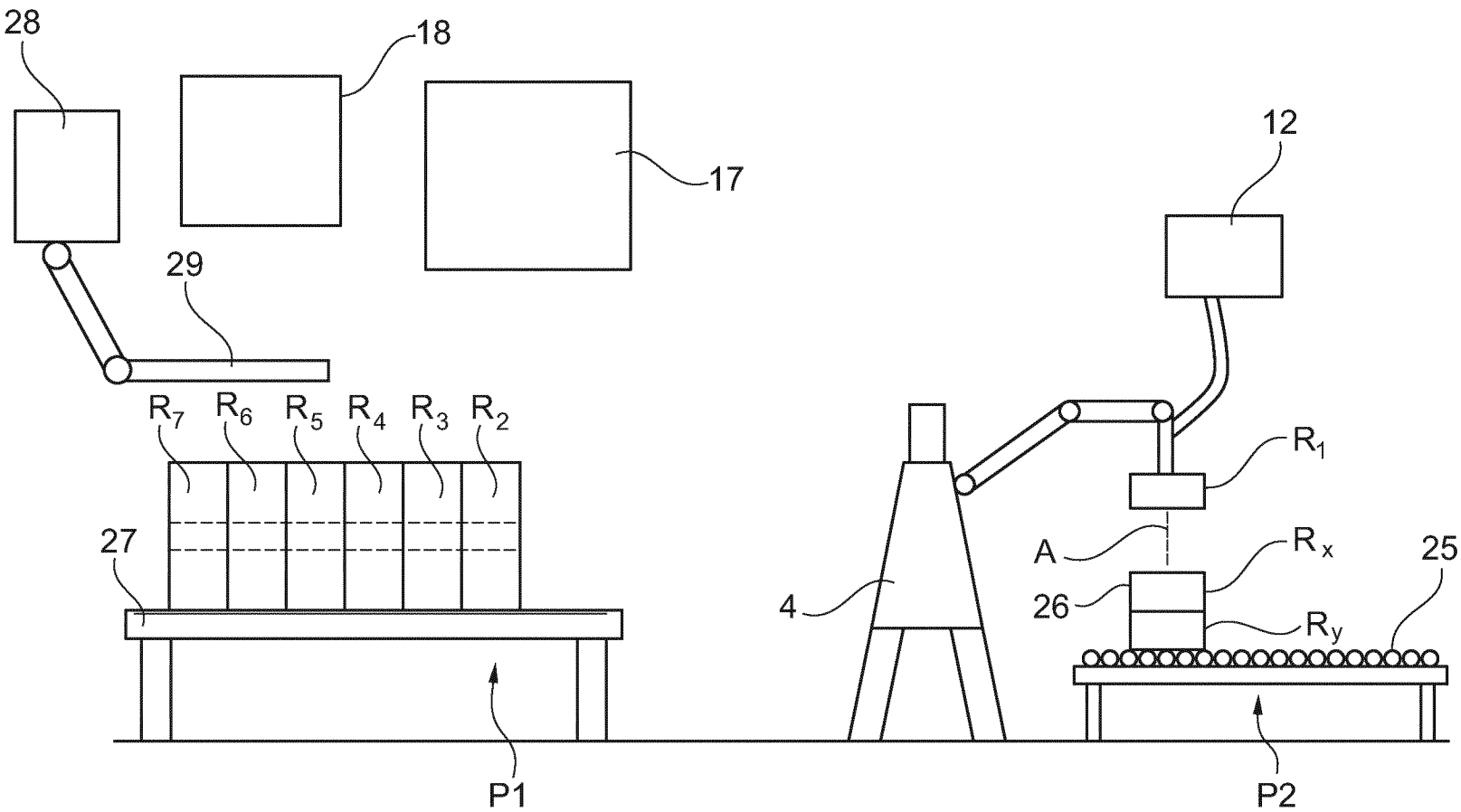
FIG. 8 is a schematic representation similar to FIGS. 3-7 showing the next step.
Figure 9:
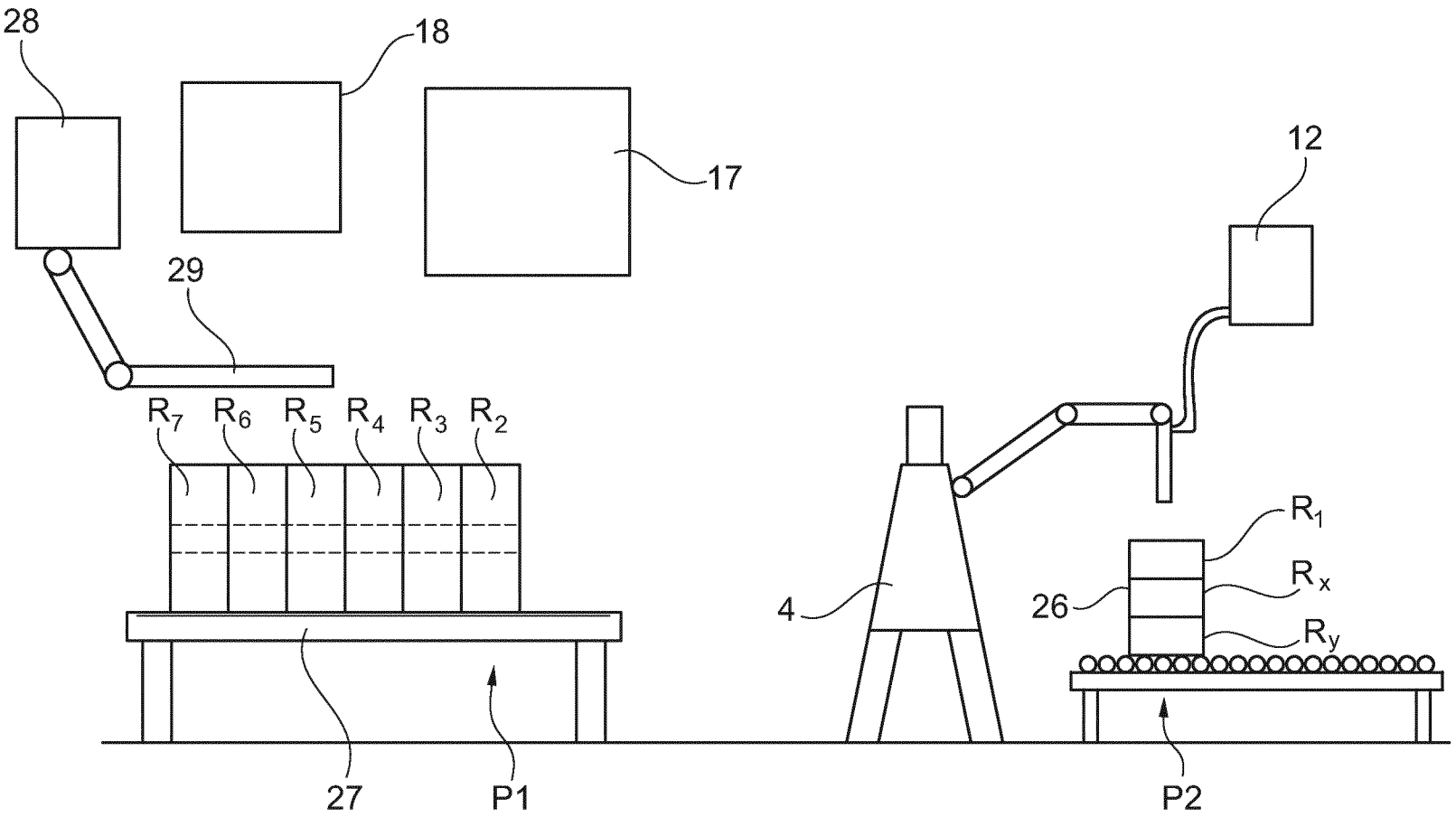
FIG. 9 is a schematic representation similar to FIGS. 3-8 in which a final step is shown.

In FIG. 8, the reel $R_1$ has been turned/rotated such that its central axis A is vertical and the reel $R_1$ is held above the stack 26 which is standing on the roller conveyor 25. In FIG. 9, the robot arm 6 has positioned the reel $R_1$ above or on the stack 26 and released it such that the reel $R_1$ now forms a part of the stack 26.

Figure 10:
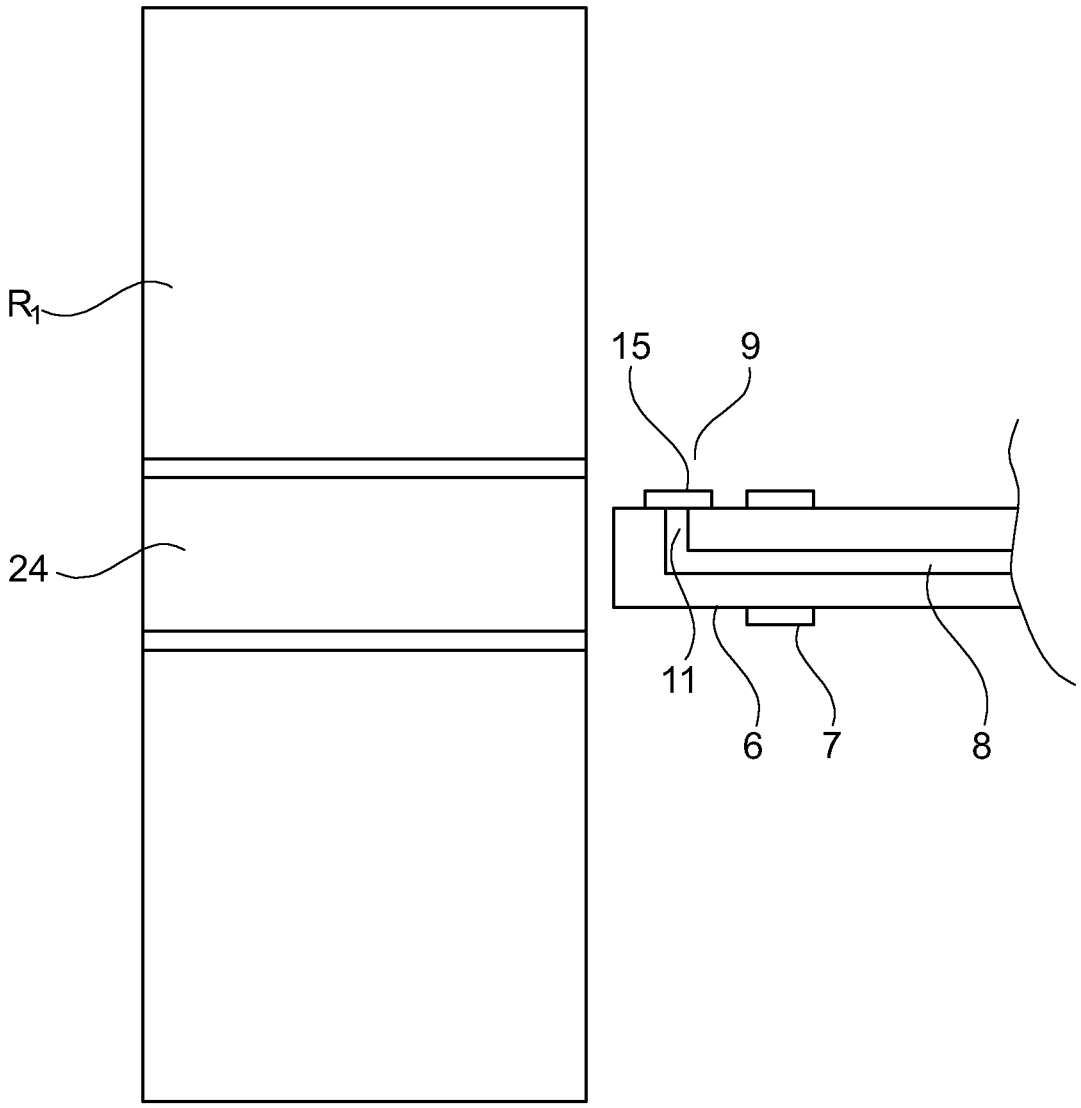
FIG. 10 is a schematic representation showing in greater detail a part of the method step illustrated in FIG. 4.

The function of the industrial robot and its carrier robot arm 6 will now be explained with reference to FIGS. 10-13. As can be seen in FIG. 10, the robot arm 6 has an inner conduit 8. This inner conduit 8 is connected to the pressure control arrangement 12, directly or indirectly, via the tube/conduit 30. At an end 9 of the robot arm 6, the conduit 8 ends in an opening 11. When the pressure control arrangement 12 is used to generate an underpressure, a label 15 can be held by suction at the opening 11 such that the label 15 is held on the robot arm. In FIG. 10, only one opening 11 is shown but it should be understood that there may be several such openings 11. The label 15 has a first side 20 which is adhesive and a second side 21 which may be printed on. When the robot arm 6 is taken to the machine for printed labels 17, it uses suction to seize and hold the label 15 by the second side 21 which does not have an adhesive.

Figure 11:
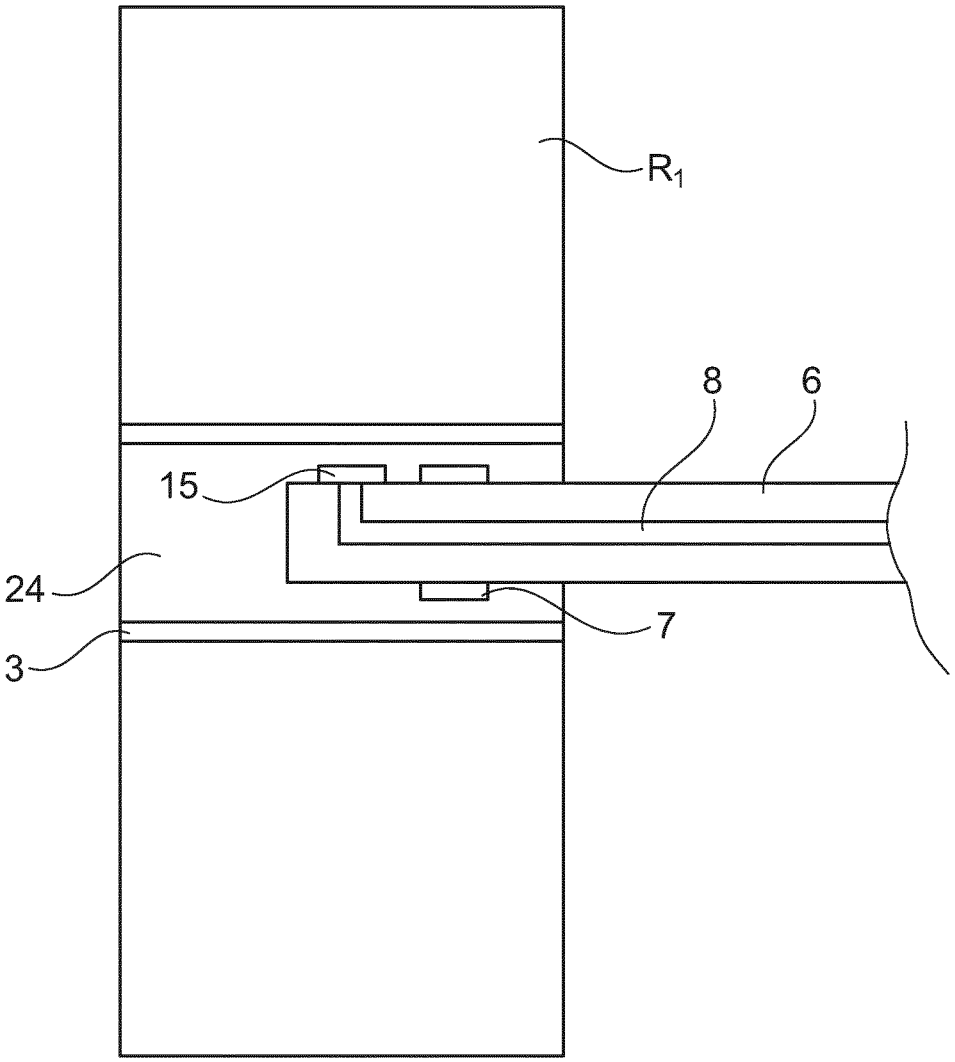
FIG. 11 is a schematic representation showing in greater detail a part of the method step illustrated in FIG. 5.

With reference to FIG. 11, it can be seen how the end of the robot arm 6 has been inserted into the central core piece 3 of the reel $R_1$. The label 15 is still held on the robot arm 6.

Figure 12:
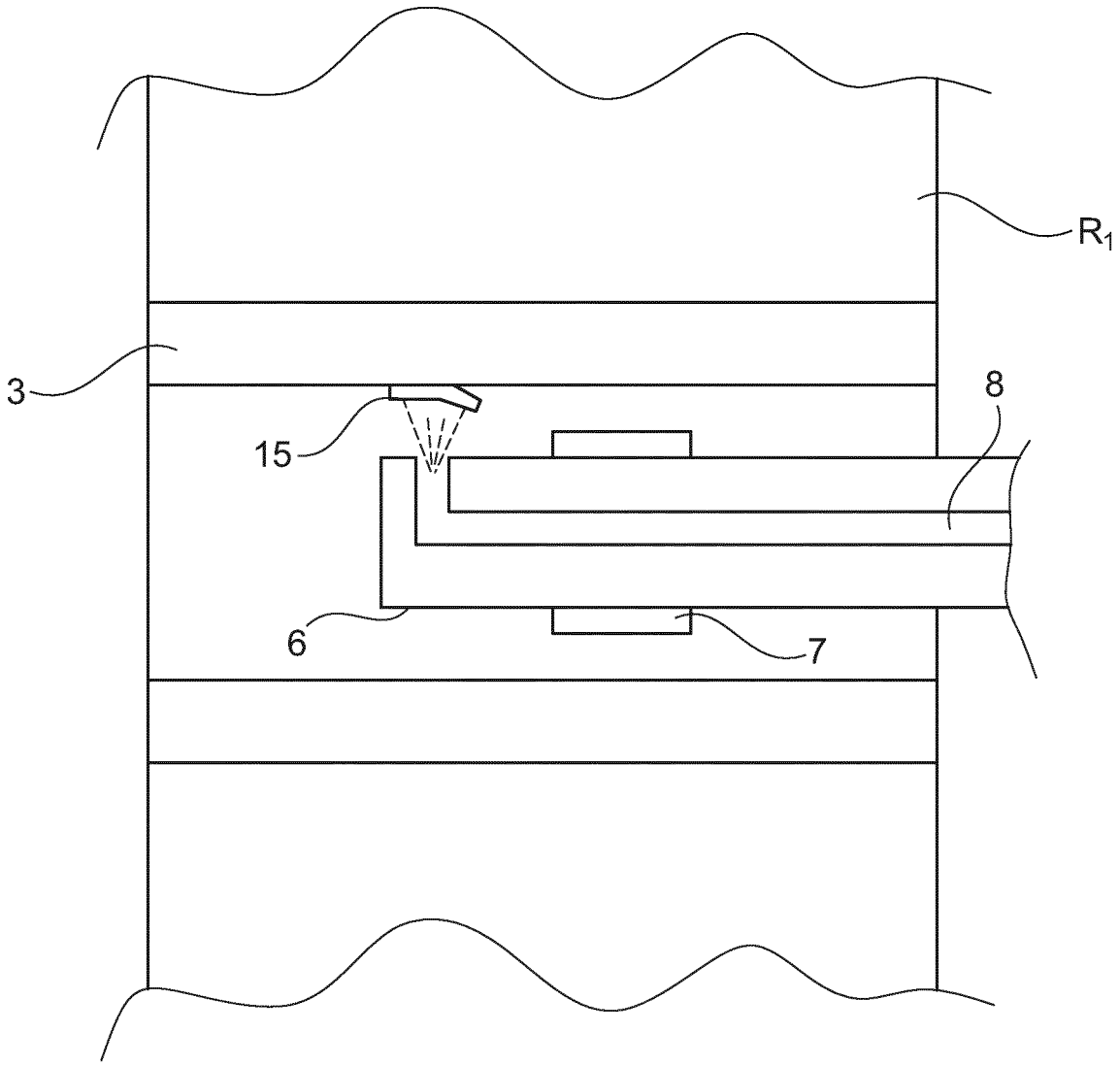
FIG. 12 is a schematic representation similar to FIG. 11 but illustrating how a label is fixed to the inner core.
Figure 16:
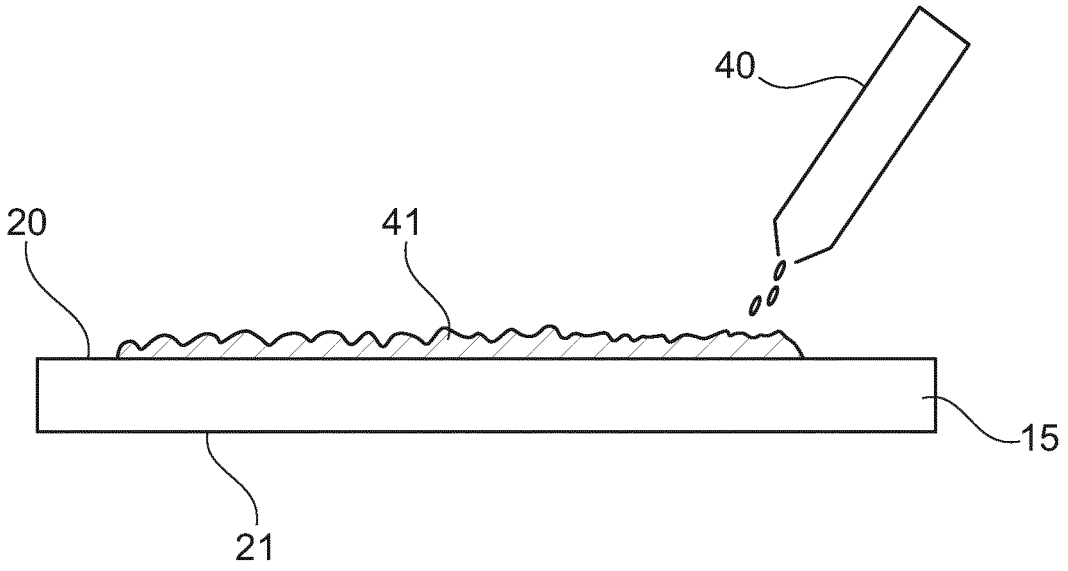
FIG. 16 is a schematic cross-sectional representation of a label.

FIG. 12 shows the next step. The pressure control system 12 has now reversed its action and suction is no longer generated. Instead, pressurized air or gas is fed through the conduit 8 such that the label 15 is blown away from the robot arm 6 and is thrown against the central core piece 3. The first side 20 of the label 15 which has not been in contact with the robot arm 6 has been at least partially covered with an adhesive and the label 15 will now be fixed to the central core piece 3 by the adhesive. The adhesive can be applied to the label 15 by the machine for printed labels 17 or by a separate machine (not shown). Conceivably, the industrial robot 4 could also be arranged to be capable of applying an adhesive to the label. With reference to FIG. 16, it can be seen that the label 15 has a first side 20 side to which an adhesive 41 is applied by an adhesive applicator 40 which may be a part of the machine for printed labels 17 or possibly arranged on the industrial robot 4 or some other part of the system 1. It should also be understood that the adhesive may have been applied long before the label is picked up by the robot arm 6. This could be the case, for example, it the labels are taken by the robot arm 6 from a spool of preprinted labels. The label 15 also has a second side 21 to which adhesive is not applied. It will be understood that suction from the robot arm 6 will be applied against the second side 21 of the label 15.

Figure 13:
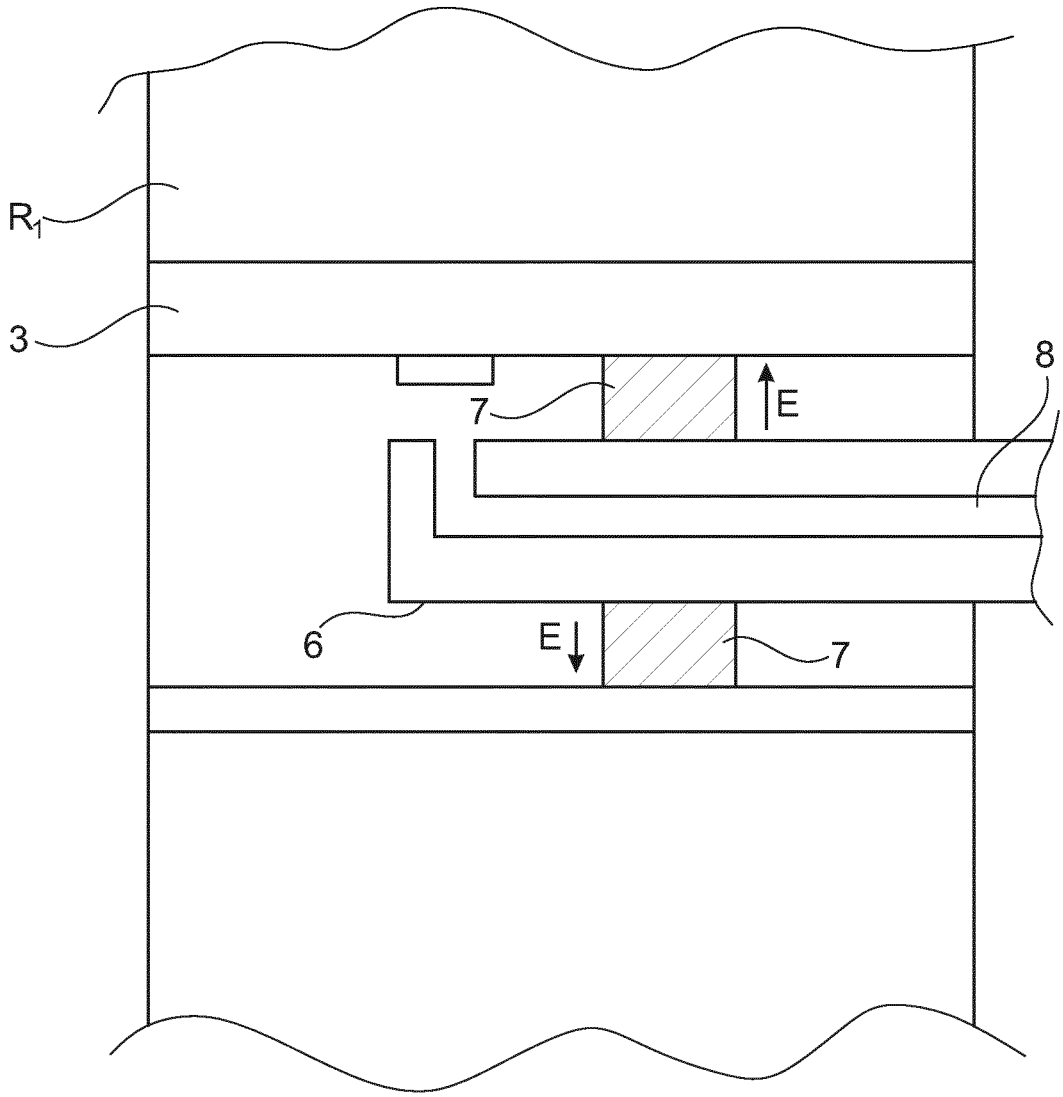
FIG. 13 is a schematic representation similar to FIG. 13 but illustrating how the robot arm grips a reel.

In FIG. 13, the label 15 is fixed to the central core piece 3. A part 7 of the robot arm 6 is a gripping part which is designed to be capable of expanding and function as a gripping part such that it can grip a reel (or more than one reel). In FIG. 13, the part 7 has expanded radially as indicated by arrows E. The gripping part 7 now presses against the central core piece 3 such that the central core piece 3 and the entire reel $R_1$ is forcefully held by the robot arm 6. The robot arm 6 can now move the reel $R_1$ and turn it as the reel is securely held by the robot arm. When the robot arm 6 and the reel $R_1$ which is held by the robot arm have reached the position shown in FIG. 8 the robot arm 6 can release the reel $R_1$ and begin a new cycle. The gripping 7 part is located adjacent the at least one opening 11 in the robot arm 6. The expansion of the gripping part 7 can be achieved in several different ways known to the skilled person and will not be described in detail. Likewise, the exact design of the industrial robot 4 and how the robot arm is designed for movement will not be described in detail since industrial robots as such are well known. The expansion of the gripping part 7 will preferably take place after the inner label 15 has been attached to the central core piece 3 but the expansion could conceivably take place at the same time as the inner label 15 is attached to the central core piece 3 or even before the inner label 15 has been attached to the central core piece 3. In preferred embodiments, the at least one opening 11 is located adjacent but separate from the gripping part 7. However, in embodiments of the invention, the at least opening 11 could be located in the expanding gripping part itself such that expansion of the gripping part 7 causes the inner label 15 to be attached to the central core piece 3.

Figure 14:
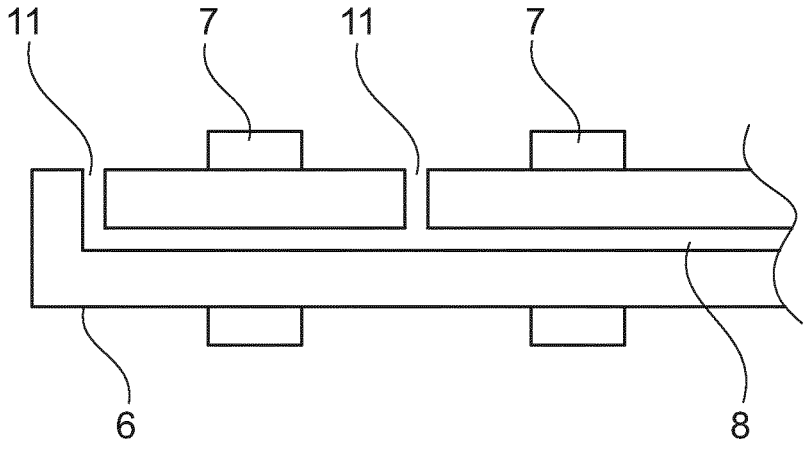
FIG. 14 is a schematic representation of an alternative embodiment of the robot arm.
Figure 15:
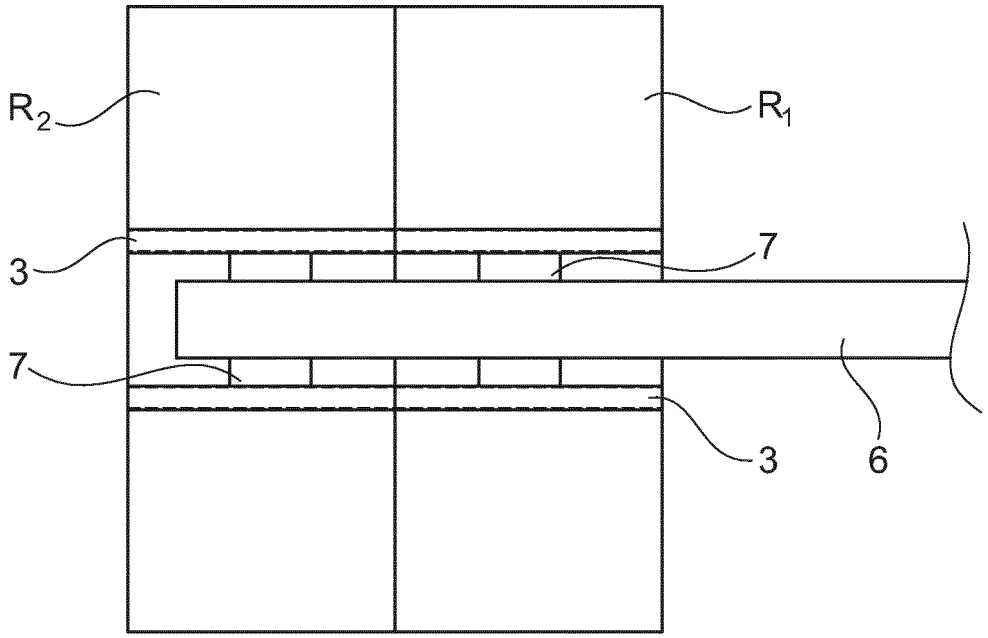
FIG. 15 is a schematic representation of how the robot arm of FIG. 14 can interact with two reels.

FIG. 14 shows an alternative embodiment in which the robot arm 6 has at least two openings 11 for suction effect and pressurized air or gas and at least two expanding gripping parts 7. In this way, the robot arm 6 can be used to grip and label two reels $R_1$, $R_2$ at the same time. It is to be understood that the robot arm 6 could similarly be designed with additional openings 11 and expanding gripping parts 7 such that it can handle three reels, for reels or even more reels at the same time.

As indicated in FIG. 3, the system 1 may optionally have a second industrial robot 28 which can pick labels 16 that are placed on the exterior surface 19 of each reel. Alternatively, the industrial robot 4 could be used to place labels on both the central core piece 3 and the exterior surface 19 of each reel.

Optionally, there may be a separate machine for printed labels 18 for providing external labels 16, for example by printing the external labels 16.

While the sequence has been described above such that the inner label 15 (i.e. the label fixed on the central core piece 3) is fixed to the central core piece 3 before the expandable gripping part 7 has gripped the reel $R_1$. However, it should be understood that the sequence may be such that the reel is first gripped by the robot arm 6 and the label 15 applied to the central core piece 3 thereafter, for example before the reel $R_1$ is moved or during movement of the reel $R_1$ from its first position P1 to its second position P2 or even just before the reel $R_1$ is dropped onto the stack.

The industrial robot 4 may comprise software with an instruction to cause the robot arm 6 to move to the at least one machine for printed labels 17, 18; to pick up at least one label (15) and hold it by means of suction; to move to the at least one reel $R_1$ and into the central core piece 3 such that the label 15 picked up from the at least one machine for printed labels 17, 18 will be inside the central core piece 3; and blow pressurized air or gas through the conduit (8) such that the label 15 picked up from the at least one machine for printed labels 17, 18 is blown against the central core piece 3. With reference to FIG. 3, the industrial robot 4 may have a central processing unit (CPU) 5 which may be programmed with the software. It should be understood that the exact location of the CPU 5 does not necessarily have to be as indicated in the figures that are only schematic representations.

Such software of the industrial robot 4 may comprise an instruction to cause radial expansion of the gripping part 7 after the label 15 picked up from the at least one machine for printed labels 17 has been blown against the central core piece 3 such that the reel $R_1$ is gripped by the robot arm 6 and an instruction to move from a first position P1 and release the at least one reel $R_1$ on a second position P2.

Alternatively, the she software of the industrial robot 4 may comprises an instruction to cause radial expansion of the gripping part 7 before the label 15 picked up from the at least one machine for printed labels 17, 18 has been blown against the central core piece 3 such that the reel $R_1$ is gripped by the robot arm 6 and an instruction to move from a first position P1 and release the at least one reel $R_1$ on a second position P2 and to simultaneously blow pressurized air or gas through the conduit 8 such that the label 15 picked up from the at least one machine for printed labels 17, 18 is blown against the central core piece 3.

While the invention has been described above in terms of a method and a system, it should be understood that these categories only reflect different aspects of one and the same invention. The system may thus include means for performing any step of the method and the method may include such steps that would be the inevitable result of using the inventive system.

Normally, the invention would be practiced such that both an internal label and an external label are applied. However, it should be understood that embodiments are conceivable in which only an internal label is applied.

Thanks to the invention, the labelling of the central core pieces 3 can be made by the same industrial robot that is used to move the reels $R_1, R_2, R_3, R_4, \ldots R_n$ and the process of moving and labelling the reels $R_1, R_2, R_3, R_4, \ldots R_n$ becomes faster.

The invention claimed is:

1. A method of moving and labelling reels ($R_1, R_2, R_3, R_4, \ldots R_n$) of a web material such as paper or nonwoven, each reel ($R_1, R_2, R_3, R_4, \ldots R_n$) having a central core piece (3) which is hollow and the web material being wound around the central core piece (3), the method comprising the steps of:

inserting a robot arm (6) into the central core piece (3) of at least one reel ($R_1$);

using the robot arm (6) to move the at least one reel ($R_1$) from a first position (P1) to a second position (P2); and fixing an inner label (15) onto the central core piece (3), wherein:

the inner label (15) is placed on the robot arm (6) before the robot arm (6) is inserted into the central core piece (3); and the robot arm (6) is used both to fix the inner label (15) to the central core piece (3) and to move the at least one reel ($R_1$).

2. A method according to claim 1, wherein the inner label (15) is fixed onto the central core piece (3) before the robot arm (6) is used to move the at least one reel ($R_1$).

3. A method according to claim 2, wherein the method further comprises fixing an outer label (16) onto an exterior surface (19) of the at least one reel ($R_1$).

4. A method according to claim 1, wherein the method further comprises fixing an outer label (16) onto an exterior surface (19) of the at least one reel ($R_1$).

5. A method according to claim 1, wherein the inner label (15) is fixed onto the central core piece (3) while the at least one reel ($R_1$) is moved from the first position (P1) to the second position (P2).

6. A method according to claim 1, wherein the robot arm (6) is used to move at least two reels ($R_1, R_2$) simultaneously and fix an inner label (15) onto the central core piece (3) of each of the at least two reels ($R_1, R_2$).

7. A method according to claim 1, wherein an adhesive is applied to a first side (20) of the inner label (15), wherein suction is applied from the robot arm (6) against the second (21) side of the inner label (15) such that the robot arm (6) will hold the inner label (15) by suction when the robot arm (6) is inserted into the central core piece (3), wherein the suction is interrupted when the inner label (15) is to be fixed to the central core piece (3) and wherein pressurized air or gas is used to blow the inner label (15) away from the robot arm (6) toward the central core piece (3) such that the side (20) of the inner label (15) that is provided with an adhesive will come into contact with the central core piece (3).

8. A method according to claim 1, wherein a part (7) of the robot arm (6) that is inserted into the central core piece (3) is caused to expand and press against the central core piece (3) of the at least one reel ($R_1$) such that the at least one reel ($R_1$) is held by the robot arm (6) while the at least one reel ($R_1$) is still in the first position (P1) and in that the robot arm (6) moves the at least one reel ($R_1$) which is now held by the robot arm (6) and releases the at least one reel ($R_1$) at the second position (P2).

9. A method according to claim 8, wherein the robot arm (6) stacks several reels ($R_1, R_2, R_3, R_4, \ldots R_n$) on top of each other at the second position (P2).

10. A system (1) for moving and labelling reels ($R_1, R_2, R_3, R_4, \ldots R_n$) of a web material such as paper or nonwoven, each reel ($R_1$, $R_2$, $R_3$, $R_4$, . . . $R_n$) having a central core piece (3) which is hollow and the web material being wound around the central core piece (3), the system (1) comprising:

at least one machine for printed labels (17, 18); and at least one industrial robot (4) with a moveable robot arm (6) that can be inserted into the central core piece (3) of at least one reel ($R_1$) and move the at least one reel ($R_1$) from a first position (P1) to a second position (P2), wherein the robot arm (6) has an inner conduit (8) which at one end (9) communicates with at least one opening (11) in the robot arm (6) and which conduit (8) is connected to a pressure control arrangement (12) capable of creating an under-pressure at the at least one opening (11) in the robot arm (6) for holding by suction a label (15) placed over the at least one opening (11).

11. A system (1) according to claim 10, wherein the pressure control arrangement (12) is capable of blowing pressurized air or gas through the conduit (8) in the robot arm (6) for blowing away from the robot arm (6) a label (15) which has been held on the robot arm (6) by suction.

12. A system (1) according to claim 11, wherein a part of the robot arm (6) is a gripping part (7) that is designed to be capable of radial expansion such that the gripping part (7) of the robot arm (6) can be inserted into the central core piece (3) of at least one reel ($R_1$) and grip the at least one reel ($R_1$) when the gripping part (7) is radially expanded.

13. A system (1) according to claim 10, wherein a part of the robot arm (6) is a gripping part (7) that is designed to be capable of radial expansion such that the gripping part (7) of the robot arm (6) can be inserted into the central core piece (3) of at least one reel ($R_1$) and grip the at least one reel ($R_1$) when the gripping part (7) is radially expanded.

14. A system (1) according to claim 13, wherein the gripping (7) part is located adjacent the at least one opening (11) in the robot arm (6).

15. A system (1) according to claim 10, wherein the industrial robot (4) comprises software with an instruction to cause the robot arm (6) to move to the at least one machine for printed labels (17, 18); to pick up at least one label (15) and hold it by means of suction; to move to the at least one reel ($R_1$) and into the central core piece (3) such that the label (15) picked up from the at least one machine for printed labels (17, 18) will be inside the central core piece (3); and blow pressurized air or gas through the conduit (8) such that the label (15) picked up from the at least one machine for printed labels (17, 18) is blown against the central core piece (3).

16. A system (1) according to claim 15, wherein the software of the industrial robot (4) further comprises an instruction to cause radial expansion of a gripping part (7) after the label (15) picked up from the at least one machine for printed labels has been blown against the central core piece (3) such that the at least one reel ($R_1$) is gripped by the robot arm (6) and an instruction to move from a first position (P1) and release the at least one reel ($R_1$) on a second position (P2).

17. A system (1) according to claim 15, wherein the software of the industrial robot (5) further comprises an instruction to cause radial expansion of a gripping part (7) before the label (15) picked up from the at least one machine for printed labels (17, 18) has been blown against the central core piece (3) such that the at least one reel ($R_1$) is gripped by the robot arm (6) and an instruction to move from a first position (P1) and release the at least one reel ($R_1$) on a second position (P2) and to simultaneously blow pressurized air or gas through the conduit (8) such that the label (15) picked up from the at least one machine for printed labels (17, 18) is blown against the central core piece (3).

* * * * *